US006234698B1

(12) United States Patent
De Laforcade

(10) Patent No.: US 6,234,698 B1
(45) Date of Patent: May 22, 2001

(54) APPLICATOR FOR A PRODUCT OF VISCOUS CONSISTENCY, INCLUDING A POROUS DISPENSING ELEMENT

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 644 days.

(21) Appl. No.: 08/618,306

(22) Filed: Mar. 18, 1996

(30) Foreign Application Priority Data

Mar. 17, 1995 (FR) ..... 95 03147

(51) Int. Cl.[7] ..... B43K 5/06
(52) U.S. Cl. ..... 401/175; 401/206; 401/205
(58) Field of Search ..... 401/175, 205, 401/206

(56) References Cited

U.S. PATENT DOCUMENTS 2,917,765 * 12/1959 Jakubowski ..... 401/175
3,616,970 * 11/1971 Baumann et al. ..... 401/175 X
4,111,567 * 9/1978 Berghahn et al. ..... 401/205 X
4,801,052 * 1/1989 Citterio ..... 401/175 X
5,073,057 * 12/1991 Lathrop et al. ..... 401/206
5,230,579 * 7/1993 Klawson et al. ..... 401/205

FOREIGN PATENT DOCUMENTS

249473 * 10/1962 (AU) ..... 401/175
3938347 * 5/1991 (DE) ..... 401/205
0 155 349 9/1985 (EP) .
0 167 657 1/1986 (EP) .
0 374 339 6/1990 (EP) .
2 647 034 11/1990 (FR) .
2240032 * 7/1991 (GB) ..... 401/205

* cited by examiner

*Primary Examiner*—David J. Walczak
(74) *Attorney, Agent, or Firm*—Oblon, Spivak, McClelland, Maier & Neustadt, P.C.

(57) ABSTRACT

An applicator for a product of viscous consistency includes a product reservoir on top of which there is a dispensing head equipped with a rigid application element provided with pores which communicate with one another in all directions. The product has a viscosity chosen so that passage of the product through the pores under gravity and/or capillary action is prevented. The applicator includes a device for compressing the product and producing a sufficient pressure on the product to push it through the pores when a dose of product is dispensed.

10 Claims, 2 Drawing Sheets

APPLICATOR FOR A PRODUCT OF VISCOUS CONSISTENCY, INCLUDING A POROUS DISPENSING ELEMENT

BACKGROUND OF THE INVENTION

1. Field of the Invention

The present invention relates to an applicator for a creamy, lathering or pasty product, having a rigid porous dispensing dome used as the element for applying the product over the surface intended to receive the product.

More precisely, the present invention relates to an applicator for paste, lather, cream or gel, in particular an applicator intended for topical application to the skin of a user of a product with cosmetic or dermo-pharmaceutical action, such as a deodorant, perfuming, thinning or depilatory cream, a face cream or a gel for treating the scalp.

2. Discussion of the Background

In the particular case of a deodorant or antiperspirant product, it has already been proposed to apply the product by using a solid stick containing the active agent to be applied to the skin of the user; this stick is usually packaged in a case allowing it to be moved on the skin as it is consumed.

The drawbacks of such a form of presentation are, on the one hand, the requirement for special and expensive tools for packaging the product and, on the other hand, the fact that preservation of the stick is generally not perfectly ensured. This is because the solid composition used contains a large percentage of alcohol and the packaging is not generally sufficiently leaktight to prevent the alcohol from evaporating, and therefore to prevent the product from drying. Degradation of the stick therefore ensures, making the product unusable, in particular when only a small part of it remains. Comfort during use is furthermore not perfectly satisfactory because the stick lacks flexibility. Furthermore, in particular on the sensitive body regions such as the armpits, known compositions give a greasy impression on application. In brief, the user desires smooth and non-greasy application of the deodorant product, with a refreshing effect.

It has already been proposed to overcome these drawbacks by proposing an applicator of the bottle type, containing a liquid composition, there being on top of this bottle a dispensing head bearing a dispenser dome made of a rigid porous material for use as the applicator element. This type of applicator is described, for example, in EP-A-0,167,657 and FR-A-2,647,034.

The drawback of this type of packaging is twofold: on the one hand, in order to close the bottle when the product is not being used it is necessary to provide a relatively complicated dispensing head, which significantly increases the cost of the packaging; on the other hand, in order to apply the product to the skin it is necessary to perform a preliminary action of introducing the liquid into the porous dome. In these two related documents, this action consists in the prior inversion of the bottle so that the product falls under gravity into the porous dome (upside down). Furthermore, this type of packaging requires a composition with low viscosity and, in general, with a high alcohol content which firstly limits the use of new starting materials for the formulator. Furthermore, compositions for the body which contain alcohol are not very "cosmetic", and risk being poorly received by the consumer, in particular consumers who have sensitive skin. Secondly, when this applicator is laid flat, for example when the user is travelling, leaks of the product occur, in particular when the protective cap is incorrectly closed, and this constitutes a problem.

SUMMARY OF THE INVENTION

The present invention makes it possible to overcome the drawbacks mentioned above by providing for a new industrial product which includes an applicator containing a viscous product which is applied very smoothly; this application can be performed with ease at all points on the human body, and more especially in the armpits and on the legs, with uniform and homogeneous spreading of the product. This applicator can even be used with a massaging movement, with a view to promoting penetration of the product into the skin.

Thus, the present invention relates to an applicator for a product of viscous consistency, characterized in that it includes a product reservoir and a rigid application element having pores which communicate with one another in all directions. The product has a viscosity chosen so as to prevent passage of the product through the pores under gravity and/or capillary action. The applicator furthermore comprises means for compressing the product and producing a sufficient pressure on the product to push it through the pores when a dose of the product is dispensed.

Advantageously, the compression means are of mechanical type and include, according to a first alternative embodiment, a piston associated with a means for operating the piston. This operating means may include a rotationally mobile rod provided with a screw thread integral with an actuation element such as a knurled wheel. The screw thread of the rod cooperates with a complementary screw thread made in the piston.

In this case, the element for actuating the applicator assembly of the invention advantageously has a shape which is oval or elongated perpendicularly to the axis of rotation of the rod, so that this element forms a lever arm which facilitates ascent of the piston during use.

The application element is advantageously a dome having a substantially convex or planar continuous application surface which may include a slight depression. This dispenser dome may include a ceramic or plastic indeformable rigid sintered material obtained, in particular, by hot compression of plastic or ceramic particles. This sintered material includes pores which communicate with one another isotropically and has a pore size ranging from 1 $\mu$m to 500 $\mu$m, the preferred pore size range extending from 50 $\mu$m to 300 $\mu$m.

The pore size is generally chosen while taking three parameters into account: first, the desired flow rate for the product to be applied, second, the surface condition of the porous dome, which must be compatible with the surface to be treated, and third the viscosity of the product. In order to define the pore size, in a known fashion, the passage flow rate of a product through a given thickness of the sintered material under a predetermined pressure difference is measured, and the equivalent cross-section of a channel providing the same flow rate under the same conditions is deduced therefrom. This equivalent cross-section thus makes it possible to determine the mean diameter of a pore when the number of pores per unit surface area of the dome is statistically known.

When the dispenser dome is made of a sintered plastic, it may include synthetic resins such as high or low density polyethylenes, polypropylenes or polyvinyl fluorides. As a variant, the dome may also be made of a rigid synthetic foam with open cells.

In order to make it possible to apply the product very smoothly, the dome advantageously has an application surface whose mean roughness is chosen in the range of 0.5 μm to 100 μm, and preferably in the range of 6 μm to 50 μm.

According to a further embodiment, the compression means may include a propellant gas and a dispensing valve which cooperates with the dispensing head. This valve is actuated by the user when applying the product to the skin. Provision may advantageously be made for this dispensing valve to be a valve which is opened by lateral tilting of its emergent rod. The product may be contained in a pouch arranged inside the reservoir, separating the product and the propellant gas. If the product contains a lathering product, advantageously a lather promoting agent, i.e., isobutane is included.

According to this embodiment, the reservoir is a cylindrical canister with a dispensing valve on its top. A fastening means is provided on the canister in order to fix a ring which supports the dispensing head.

In order to enhance the smoothness of application of the product further, elastic suspension means may be provided, for example arranged between the application element and the product reservoir, and more particularly between the application element and the ring.

In the variant with a propellant gas, the suspension means may advantageously connect (i) that end of the ring which is furthest away from the region where it is fixed on the canister to (ii) the periphery of the support of the dispenser dome. In this case, the ring and the suspension means may include a continuous wall surrounding the dispensing valve of the dispensing head which is fixed on the reservoir. Of course, these suspension means could also be produced in discontinuous form, by a plurality of successive sectors, for example in the form of tongues.

According to a particularly economical embodiment, the dispensing head is made in a single piece by plastic molding. Advantageously, apart from the suspension means of the dispenser dome, the dispensing head is a component having an axis of revolution, which is generally the axis of the canister.

According to yet another embodiment, the compression means may include a dispensing pump which cooperates with a lever arm articulated to the dispensing head. This pump is actuated by the user when applying the product to the skin.

According to another embodiment, the pump may be an air pump, creating an excess pressure in the reservoir, this excess pressure acting on the product to cause it to be dispensed.

The consistency of the product to be applied is viscous; this viscosity is advantageously chosen in the range of 50 mPa s to 7 Pa s, and preferably in the range of 90 mPa s to 5 Pa s.

A further subject of the invention is a deodorant including a reservoir for a deodorant product, a product application element provided with pores which communicate with one another in all directions, the product having a viscosity chosen so that passage of the product through the pores under gravity and/or capillary action is prevented, and means for compressing the product, which can produce a sufficient pressure on the product to make it pass through the pores, when the product is applied. The deodorant application element has the shape of a dome.

BRIEF DESCRIPTION OF THE DRAWINGS

In describing the preferred embodiments of the present invention illustrated in the drawings, specified terminology is employed for the sake of clarity. However, the invention is not intended to be limited to the specific terminology so selected and it is to be understood that each specific element includes all technical equivalents which operate in a similar purpose.

A more complete appreciation of the invention and many of the attendant advantages thereof will be readily obtained as the same becomes better understood by reference to the following detailed description when considered in connection with the accfompanying drawings, wherein.

DESCRIPTION OF THE PREFERRED EMBODIMENTS

Figure 1:
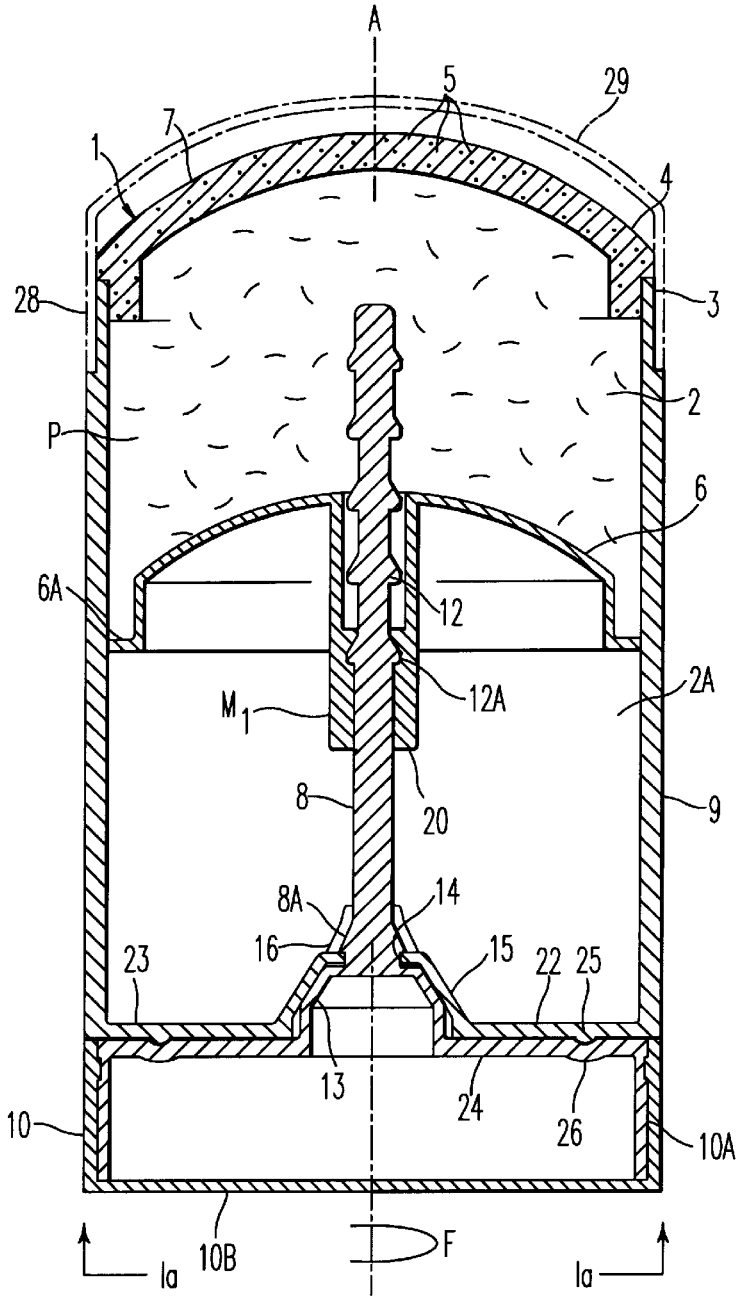
FIG. 1 represents an applicator according to the invention in axial section, according to a first embodiment of the invention, in a storage position.

Referring now to the drawings, wherein like reference numerals designate identical or corresponding parts throughout the several view, the applicator 1 shown in FIG. 1 includes a reservoir 2 containing a product P, for example a deodorizing cream, and including a cylindrical body 9 having a longitudinal axis A. The cross-section of the body 9 perpendicular to the axis may be circular, but an oval cross-section is preferred according to the present embodiment, for the reasons explained below.

In this Figure, the cylindrical body 9 has at one of its ends a dispensing head 3 fitted with a dome-shaped rigid and indeformable porous application element 4. The head 3 further includes a region 28 of reduced diameter, which constitutes the seat of a protective cap 29, the internal cross-section of which corresponds to the external cross-section of the region 28. The second end of the body 9, opposite the element 4, includes an actuation element 10 in the form of an elongate handle, of the same oval cross-section as the reservoir. The actuation element or handle 10 is mounted so as to pivot about the axis A of the assembly. The compression mechanism $M_1$ includes, for example, a piston 6 which is associated with the actuation element 10.

The side wall 10*a* of the actuation element 10 constitutes a gripping surface which is accessible over the entire periphery of the element 10. A user can thus grip the element 10 and pivot it about the axis A, as symbolized in FIG. 1 by the arrow F.

Figure 1A:
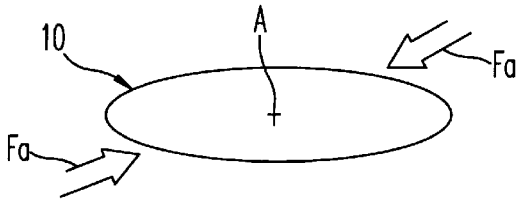
FIG. 1*a* is a view along the direction Ia—Ia in FIG. 1.

In particular, the element 10 presents preferential bearing regions, marked in FIG. 1*a*, on which a force symbolized by two arrows $F_a$ will be applied. It can be seen that the moment of the forces $F_a$ which is exerted can be a strong moment, because of the elongate shape of the element 10.

As represented in FIG. 1, the body 9 internally includes a piston 6 whose cross-section corresponds precisely to the internal cross-section of the body 9. At its center, the piston 6 has an orifice 20 with an internal screw thread 12*a*, through which a rod 8 provided with a screw thread 12 passes. The rod 8 extends over virtually the entire height of the body 9. The rod 8 is mounted so that it can rotate freely about the axis A of the assembly, while being axially blocked by virtue of a frustoconical shoulder 8*a* of the end wall 22 of the body 9. The wall 22 has a shape which is designed to receive the frustoconical head 13 of the threaded rod 8. In fact, the end wall 22 includes an orifice 14 which is extended downwards by a frustoconical edge 15, forming a support for the frustoconical part of the head 13 of the rod 8. The frustoconical edge 15 is connected to a planar part 23 of the end wall 22. The shoulder 8*a* is surrounded by an elastic sleeve 16, in order to seal the interior of the reservoir 2 from the exterior, thus preventing the entry of any surrounding air which might lead to drying or degradation of the product which is packaged.

The head 13 of the rod 8 is secured to the actuation element 10. In fact, the head 13 connects with an oval plate 24 which is of the same size as the cross-section of the body 9. The edges of the plate 24 connect with the side wall 10*a* of the actuation element 10. The end of the element 10 is closed by a plate 10*b* which has the same shape and size as the plate 24.

The planar part 23 of the end 22 and the plate 24 are provided with systems, each comprising a boss 25 and a hollow-part 26, arranged facing each other; and cooperating with each other; this system allows the user to reposition the actuation element 10 with ease in the extension of the body 9.

The piston 6 furthermore includes at its periphery a sealing lip 6*a* which bears strongly against the side wall of the body 9 and creates a perfect seal between the reservoir 2 and the volume 2*a* defined between the piston 6 and the end 22. Therefore, rotation of the rod 8 causes movement of the piston 6 which pushes the product through the porous application element 4.

According to an advantageous aspect of the invention, the pitch of the screw thread of the rod 8 is chosen as a function of the viscosity of the product and the size of the pores 5 in the application element 4; for a product which has a high viscosity, and for a small pore size, the pitch of the screw thread must be small, and vice versa.

The application element 4, may include a sintered ceramic or plastic, in particular a material obtained by hot compression of particles; for example, a sintered material obtained by compressing calibrated polyethylene balls can be obtained. This sintered material may have a porosity of between 1 $\mu$m and 200 $\mu$m. For this range of pore sizes, the pitch of the screw thread must be small.

In the example in question, the application element 4 has a pore size of approximately 40 $\mu$m. Its outer face 7 has a bulged shape, the convexity of which points outwards. The roughness of the surface 7 of the dome 4 is such that the mean $R_a$ of the roughness deviations is of the order of 15 $\mu$m; $R_a$ is the arithmetic mean of the distances between the actual surface and the median surface; this arithmetic mean is given by the formula:

$$R_a = 1/l_m \int_0^{l_m} |f(x)|\, dx$$

in which f(x) measures the distance from the actual surface to the median surface at a point x of length $l_m$, measured using a "SURFTEST 301" instrument marketed by the company Mitutoyo.

The product P contained in the reservoir 2 has a viscosity of approximately 120 mPa s.

This applicator allows smooth and easy application over a wide region of the skin, for example in the armpits.

Figure 2:
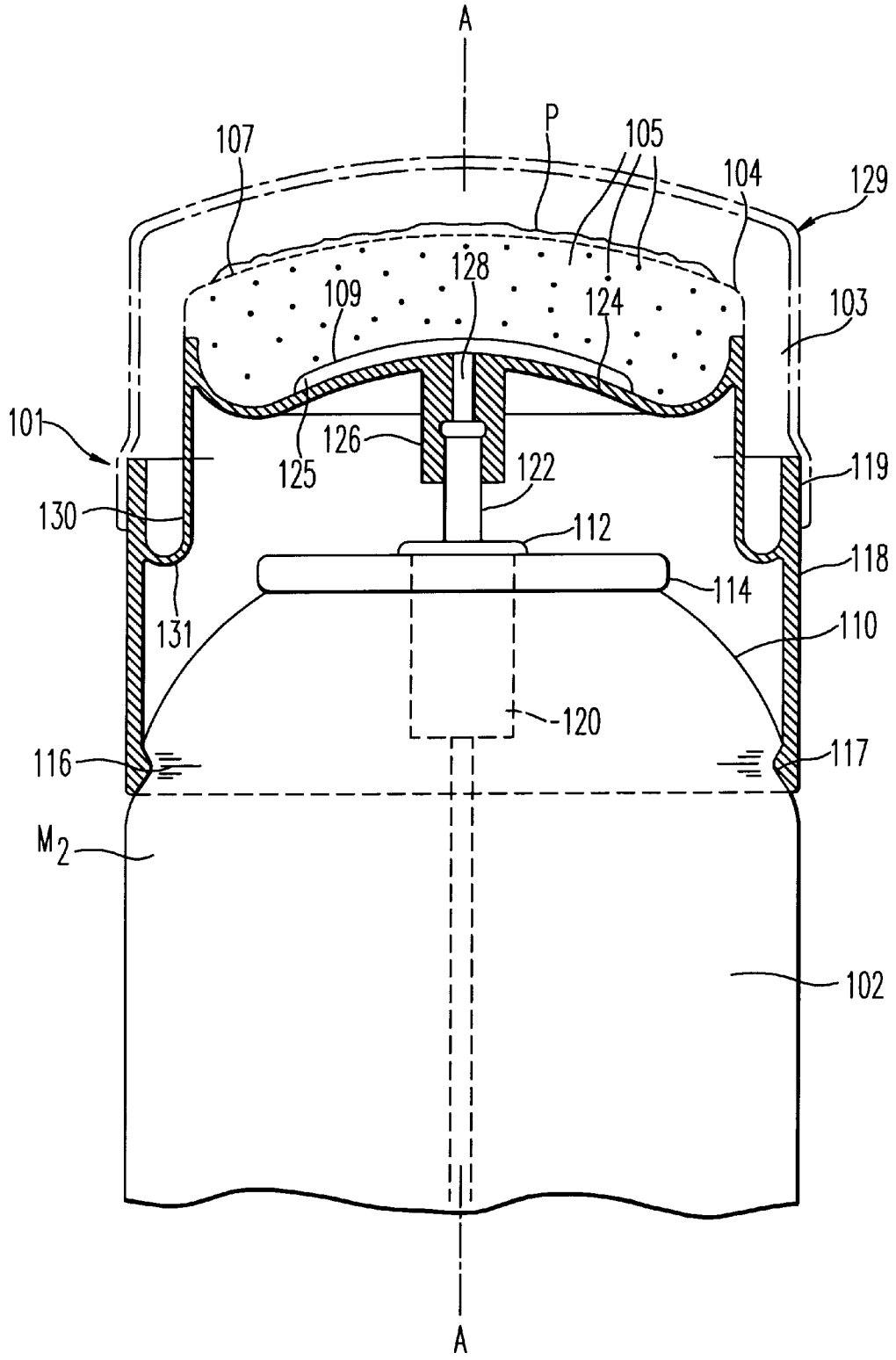
FIG. 2 represents, in axial section, a second embodiment of an applicator of the invention.

In FIG. 2, reference 101 denotes the applicator for a product of viscous consistency, according to another alternative embodiment of the invention.

Referring to this Figure, it is seen that 102 denotes the pressurized reservoir of the applicator. This reservoir 102 is a cylindrical canister of circular cross-section, the top of which is shaped as an ogive 110, on the top of which there is a valve dish 112 secured to the canister by a crimp 114. Along its axis A, the valve dish supports a dispensing valve 120 which has an emergent rod 122; the valve 120 is opened by tilting the emergent rod 122 laterally.

In the region where the ogive 110 joins the cylindrical wall of the reservoir 102, a peripheral snap-fastening groove 116 is seen.

The product, for example a depilatory gel, is packaged under pressure in the reservoir 102. This gel has a viscosity of approximately 300 mPa s. The reservoir may be pressurized either by placing the product directly in contact with propellant gas or by separating the product and propellant gas by a mobile piston or by a deformable flexible pouch, the latter case obviating the necessity to use the applicator in a defined position, with the valve either at the top or at the bottom. The compression mechanism $M_2$ includes the valve 120 and a propellant gas which cooperates with an application element 104.

A dispensing head 103 is fixed on the reservoir 102, the head 103, including, on the one hand, a cylindrical ring 118 and, on the other hand, a second dish 124 which constitutes the support for the dome-shaped application element 104 which includes a material similar to that shown in FIG. 1. On the inside, at its base, the ring 118 includes an annular snap-fastening lip 117 which is intended to cooperate with the snap-fastening groove 116.

The dispensing head 103 furthermore includes a flexible element 130 which connects the dish 124 and the ring 118. The flexible element 130 is formed by a plurality of uniformly distributed tongues. The ring 118 is joined to the dish 124 by a rounded region 131, the convexity of which faces the snap-fastening lip 117. The ring 118 and the flexible element 130 have cylindrical general shapes and are arranged coaxially. The ring 118 is connected to the flexible element 130 at its free end 119. In addition, the flexible element 130 connects with the plate 124 along its border opposite the end 119. In its central region, the dish 124 is secured to a hollow adaptor 126 of cylindrical shape. Along its axis, the adaptor 126 includes a passage 128, in which the free end of the emergent rod 122 of the valve 120 is engaged in order to obtain a leaktight connection between the rod 122 and the adaptor 126.

Substantially radial channels 125 are arranged between the internal face of the support 124 and the lower face of the dispenser dome 104, it being possible for the channels 125 to be produced in the dispenser dome itself and/or in the wall of the support 124. The channels 125 have the advantage of ensuring a good distribution of the product to be dispensed. The external face 107 of the dispenser dome 104 thus delivers the product uniformly.

A protective cap 129 is provided in order to protect the application element 104.

In order to use the applicator described above, the user presses the external face 107 of the dome 104 against the surface to be treated, for example the skin of a leg from which hair is to be removed. The applicator is then moved laterally. This produces a frictional force which causes the flexible element 130 to deform and, consequently, leads to a substantially radial movement of the dish 124 relative to the reservoir 102 and relative to the axis of the valve 120. A lateral tilting of the rod 122 results, and consequently the valve is opened, with the simultaneous ejection of a depilatory gel packaged under pressure in the reservoir 102. The gel reaches the internal face 109 of the dispenser dome 104, then it is distributed over the entirety of this internal face and, under the effect of the dispensing pressure, it passes through the sintered material constituting the dome 104 before reaching the level of the external face 107 of this dome.

The gel is then dispensed on the leg by friction; if there is an excess of product, the frictional force decreases, which causes the valve 120 to close under the effect of the elastic return means provided inside the valve.

Use of this application is particularly reliable, and there is no possibility of leakage. In addition, the comfort when making a topical application using this applicator is very satisfactory, because the user has the sensation of a smooth and non-greasy application, with a refreshing effect. Furthermore, application can be carried out directly without previously inverting the applicator.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An applicator for a product of a viscous consistency, the applicator comprising:

a cylindrical body having a first end;

a rigid and non-deformable porous application element fitted on the first end of the cylindrical body, said application element having pores which communicate with one another in all directions;

a piston provided within the cylindrical body, the piston being movable along a longitudinal axis of the cylindrical body;

a product reservoir for containing a product having a viscous consistency, the product having a viscosity chosen so that passage of the product through the pores under gravity and/or capillary action is prevented, the product reservoir being positioned within the cylindrical body and between the piston and the application element, a top of said product reservoir being defined by said application element; and means for moving the piston so as to compress the product in the product reservoir and produce a sufficient pressure on the product to push the product through the pores when a dose of product is dispensed.

2. An applicator according to claim 1, wherein the means for moving the piston comprises a rod provided with a screw thread integral with an actuation element, the screw thread of the rod cooperating with a complementary screw thread on the piston.

3. An applicator according to claim 1, wherein the application element has a pore size chosen from a range of 1 $\mu$m to 500 $\mu$m.

4. An applicator according to claim 1, wherein the application element has a pore size chosen from a range of 50 $\mu$m to 300 $\mu$m.

5. An applicator according to claim 1, wherein the application element has a surface with a mean roughness $R_a$ chosen from a range of 0.5 $\mu$m to 100 $\mu$m.

6. An applicator according to claim 1, wherein the application element has a surface with a mean roughness $R_a$ chosen from a range of 6 $\mu$m to 50 $\mu$m.

7. An applicator according to claim 1, wherein the viscosity of the product is chosen from a range from 50 mPa s to 7 Pa s.

8. An applicator according to claim 7, wherein the viscosity of the product is chosen from a range from 90 mPa s to 5 Pa s.

9. An applicator according to claim 1, wherein said application element is domed shaped, and said piston has a dome shape which corresponds to the dome shape of the application element.

10. An applicator according to claim 1, wherein:

the cylindrical body includes a second end having an end wall with a centrally located frustoconical portion having a central opening;

the means for moving the piston comprises a rod having a screw thread integral with an actuation element, the screw thread of the rod cooperating with a complementary screw thread on the piston; and an end of the rod opposite the screw thread includes a frustoconical head which extends through the central opening of the frustoconical portion of the end wall, the frustoconical head being connected to a plate which is adjacent to the end wall of the cylindrical body and includes edges which are connected to the actuation element.

* * * * *